US010020135B2

(12) United States Patent
Chung et al.

(10) Patent No.: US 10,020,135 B2
(45) Date of Patent: Jul. 10, 2018

(54) KEY STRUCTURE AND SCISSORS-TYPE CONNECTING MEMBER THEREOF

(71) Applicant: PRIMAX ELECTRONICS LTD., Taipei (TW)

(72) Inventors: Yi Chen Chung, Taipei (TW); Chien-Hung Liu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/220,611

(22) Filed: Jul. 27, 2016

(65) Prior Publication Data

US 2017/0345588 A1 Nov. 30, 2017

(30) Foreign Application Priority Data

May 27, 2016 (TW) ..... 105116769 A

(51) Int. Cl.
*H01H 13/70* (2006.01)
*H01H 13/14* (2006.01)
*H01H 13/52* (2006.01)

(52) U.S. Cl.
CPC ..... *H01H 13/14* (2013.01); *H01H 13/52* (2013.01)

(58) Field of Classification Search
CPC .... H01H 13/7065; H01H 3/125; H01H 13/14; H01H 13/52
USPC ..... 200/344, 345
See application file for complete search history.

(56) References Cited

U.S. PATENT DOCUMENTS 9,000,313 B2 * 4/2015 Pan ..... H01H 13/7065 200/344
2014/0124345 A1 * 5/2014 Khor ..... H01H 3/125 200/344

* cited by examiner

*Primary Examiner* — Edwin A. Leon
*Assistant Examiner* — Lheiren Mae A Caroc
(74) *Attorney, Agent, or Firm* — Kirton McConkie; Evan R. Witt

(57) ABSTRACT

A scissors-type connecting member includes a first frame and a second frame. The first frame includes a rotating shaft. The second frame includes a pivot hole, an entrance and a stopper. After the rotating shaft is introduced into the pivot hole through the entrance, the first frame is pivotally coupled to the second frame. The stopper is located near the entrance or arranged between the entrance and the pivot hole. A position of the rotating shaft is limited between the stopper and the pivotal hole by the stopper. Consequently, the scissors-type connecting member is assembled easily, and the stability of connecting a first frame and a second frame of the scissors-type connecting member is enhanced. Moreover, the present invention also provides a key structure with the scissors-type connecting member.

11 Claims, 7 Drawing Sheets

KEY STRUCTURE AND SCISSORS-TYPE CONNECTING MEMBER THEREOF

FIELD OF THE INVENTION

The present invention relates to an input device, and more particularly to a key structure and a scissors-type connecting member for a keyboard device.

BACKGROUND OF THE INVENTION

Generally, the widely-used peripheral input device of a computer system includes for example a mouse device, a keyboard device, a trackball device, or the like. Via the keyboard device, the user may directly input characters and symbols into the computer. As a consequence, most users and most manufacturers of the input devices pay much attention to the keyboard devices.

Hereinafter, the structure and the function of a conventional keyboard device will be illustrated with reference to FIG. 1. FIG. 1 is a schematic top view illustrating the outward appearance of a conventional keyboard device. As shown in FIG. 1, plural keys 10 are installed on a surface of the conventional keyboard device 1. These keys 10 are classified into some types, e.g. ordinary keys, numeric keys and function keys. When one or more keys 10 are depressed by the user's fingers, a corresponding key signal is generated to the computer, and thus the computer executes a function corresponding to the depressed key or keys. For example, when an ordinary key is depressed, a corresponding English letter or symbol is inputted into the computer. When a numeric key is depressed, a corresponding number is inputted into the computer. In addition, the function keys (F1~F12) can be programmed to provide various quick access functions.

Hereinafter, the components of a key structure of the conventional keyboard device will be illustrated with reference to FIG. 2. FIG. 2 is a schematic exploded view illustrating a key structure of a conventional keyboard device. As shown in FIG. 2, the key structure 2 comprises a keycap 21, a scissors-type connecting member 22, an elastic element 23, a membrane switch circuit 24, and a base plate 25. The membrane switch circuit 24 is disposed on the base plate 25. The elastic element 23 is arranged between the keycap 21 and the membrane switch circuit 24. The scissors-type connecting member 22 is arranged between the keycap 21 and the base plate 25. In addition, the scissors-type connecting member 22 is connected with the keycap 21 and the base plate 25. The scissors-type connecting member 22 comprises an inner frame 221 and an outer frame 222. The inner frame 221 has a rotating shaft 2211. The outer frame 222 has closed pivot holes 2221. After the rotating shaft 2211 is inserted into closed pivot holes 2221, the rotating shaft 2211 is pivotally coupled with the closed pivot holes 2221. Consequently, the inner frame 221 and the outer frame 222 are swingable relative to each other.

When the keycap 21 of the key structure 2 is in an initial state, the keycap 21 is at a first height (not shown). When the key structure 2 is depressed, the keycap 21 is moved downwardly in response to the depressing force. As the keycap 21 is moved downwardly, the inner frame 221 and the outer frame 222 of the scissors-type connecting member 22 are correspondingly swung such that the inner frame 221 and the outer frame 222 are in parallel with each other. While the keycap 21 is moved downwardly, the elastic element 23 is compressed by the keycap 21, and the membrane switch circuit 24 on the base plate 25 is pressed by the elastic element 23. Consequently, the membrane switch circuit 24 is triggered to generate a corresponding key signal. Meanwhile, the keycap 21 of the key structure 2 is at a second height (not shown). The difference between the first height and the second height indicates a travelling distance of the key structure 2.

When the key structure 2 is no longer depressed, the compressed elastic element 23 provides an elastic force to the keycap 21. In response to the elastic force, the keycap 21 is moved upwardly. As the keycap 21 is moved upwardly, the inner frame 221 and the outer frame 222 are towed by the keycap 21 and correspondingly swung. Consequently, the keycap 21 is returned to the first height.

That is, after the force exerted on the keycap 21 is eliminated, the keycap 21 has to be returned to the first height. For achieving this purpose, the elastic element 23 has to push the keycap 21 back to its original position. In addition, the inner frame 221 and the outer frame 222 need to cooperate with each other to precisely control the upward moving action of the keycap 21 in the vertical direction. In other words, the performance of the scissors-type connecting member 22 is a very important factor that influences the quality and the use life of the overall key structure 2.

Moreover, for combining the inner frame 221 with the outer frame 222, the user needs to manually prop open the outer frame 222 to widen the distance between the two closed pivot holes 2221, which are respectively located at bilateral sides of the outer frame 222. Consequently, the rotating shaft 2211 can be successfully inserted into the closed pivot holes 2221 to result in the combination between the inner frame 221 and the outer frame 222. The procedure of manually propping-open the outer frame 222 increases the assembling time of the key structure 2. Since procedure of propping-open the outer frame 222 cannot be automatically performed by a machine, the throughput is low.

For solving the above drawbacks, an improved scissors-type connecting member is disclosed in Taiwanese Utility Model Patent M448779. FIG. 3 is a schematic perspective view illustrating a scissors-type connecting member is disclosed in Taiwanese Utility Model Patent M448779. The structure of the scissors-type connecting member 22' of FIG. 3 is similar to the structure of FIG. 2. In comparison with FIG. 2, the outer frame 222' of the scissors-type connecting member 22' has an entrance 2222. An entrance width L8 of the entrance 2222 corresponds to an axial length L9 of a rotating shaft 2211' of the inner frame 221'. A guiding surface 2223 is arranged between a pivot hole 2221' and the entrance 2222. For example, the entrance width L8 is equal to or slightly larger than the axial length L9 of the rotating shaft 2211' of the inner frame 221'. During the process of combining the inner frame 221' with the outer frame 222', the rotating shaft 2211' of the inner frame 221' is introduced into the pivot hole 2221' through the entrance 2222 at a specified angle and in a specified direction and moved along the guiding surface 2223. Moreover, the rotating shaft 2211' of the inner frame 221' has two flat slant surfaces 22111 and 22112. While the rotating shaft 2211' is introduced into the pivot hole 2221', the two flat slant surfaces 22111 and 22112 interfere with the bottom surface of the pivot hole 2221' and the guiding surface 2223. Consequently, the rotating angle of the inner frame 221' relative to the outer frame 222' is limited.

Due to the design of the entrance 2222 and the guiding surface 2223, the inner frame 221' can be combined with the outer frame 222' quickly, and the scissors-type connecting member can be assembly automatically. However, if the assembled keyboard drops down (e.g., drops down accidentally or undergoes a reliability drop test before leaving the factory) or the assembled keyboard is hit by an external force, some problems occur. For example, the rotating shaft 2211' of the inner frame 221' is easily moved along the guiding surface 2223 and escaped from the entrance 222 at the specified angle and the specified direction. Under this circumstance, the scissors-type connecting member 22' is disassembled and the components of the key structure 2 are scattered.

Therefore, the conventional key structure and the scissors-type connecting member need to be further improved.

SUMMARY OF THE INVENTION

An object of the present invention provides a scissors-type connecting member. The scissors-type connecting member is assembled easily, and the stability of connecting a first frame and a second frame of the scissors-type connecting member is enhanced.

Another object of the present invention provides a key structure. The key structure has the scissors-type connecting member of the present invention.

In accordance with an aspect of the present invention, there is provided a scissors-type connecting member. The scissors-type connecting member includes a first frame and a second frame. The first frame includes a rotating shaft. The rotating shaft is disposed on an outer surface of the first frame. The second frame includes a mounting part. The mounting part is disposed on an inner surface of the second frame. Moreover, the mounting part includes an entrance, a pivot hole and a stopper. After the rotating shaft is introduced into the pivot hole through the entrance, the first frame is pivotally coupled to the second frame. The stopper is located near the entrance or arranged between the entrance and the pivot hole. A position of the rotating shaft is limited between the stopper and the pivotal hole by the stopper.

In accordance with another aspect of the present invention, there is provided a key structure. The key structure includes a base plate, a keycap and a scissors-type connecting member. The keycap is disposed over the base plate. The scissors-type connecting member is arranged between the base plate and the keycap. The keycap is moved upwardly or downwardly relative to the base plate through the scissors-type connecting member. The scissors-type connecting member includes a first frame and a second frame. The first frame includes a rotating shaft. The rotating shaft is disposed on an outer surface of the first frame. The second frame includes a mounting part. The mounting part is disposed on an inner surface of the second frame. Moreover, the mounting part includes an entrance, a pivot hole and a stopper. After the rotating shaft is introduced into the pivot hole through the entrance, the first frame is pivotally coupled to the second frame. The stopper is located near the entrance or arranged between the entrance and the pivot hole. A position of the rotating shaft is limited between the stopper and the pivotal hole by the stopper.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
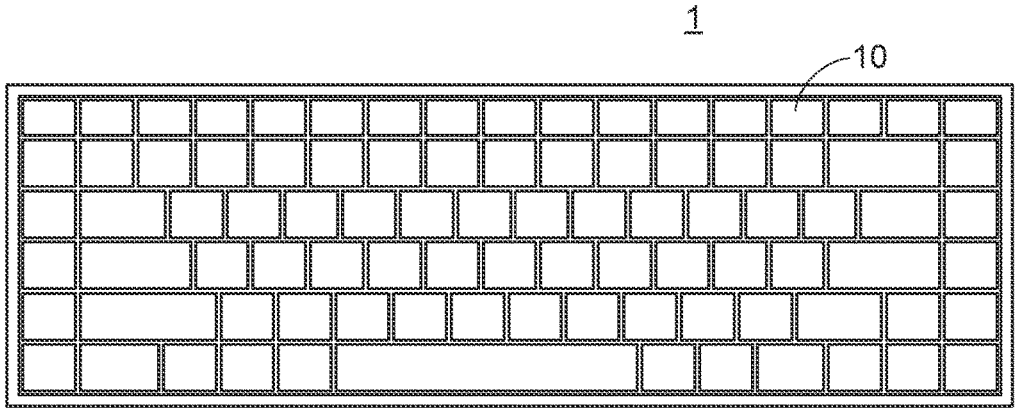
FIG.1 PRIOR ART
FIG. 1 is a schematic top view illustrating the outward appearance of a conventional keyboard device.
Figure 2:
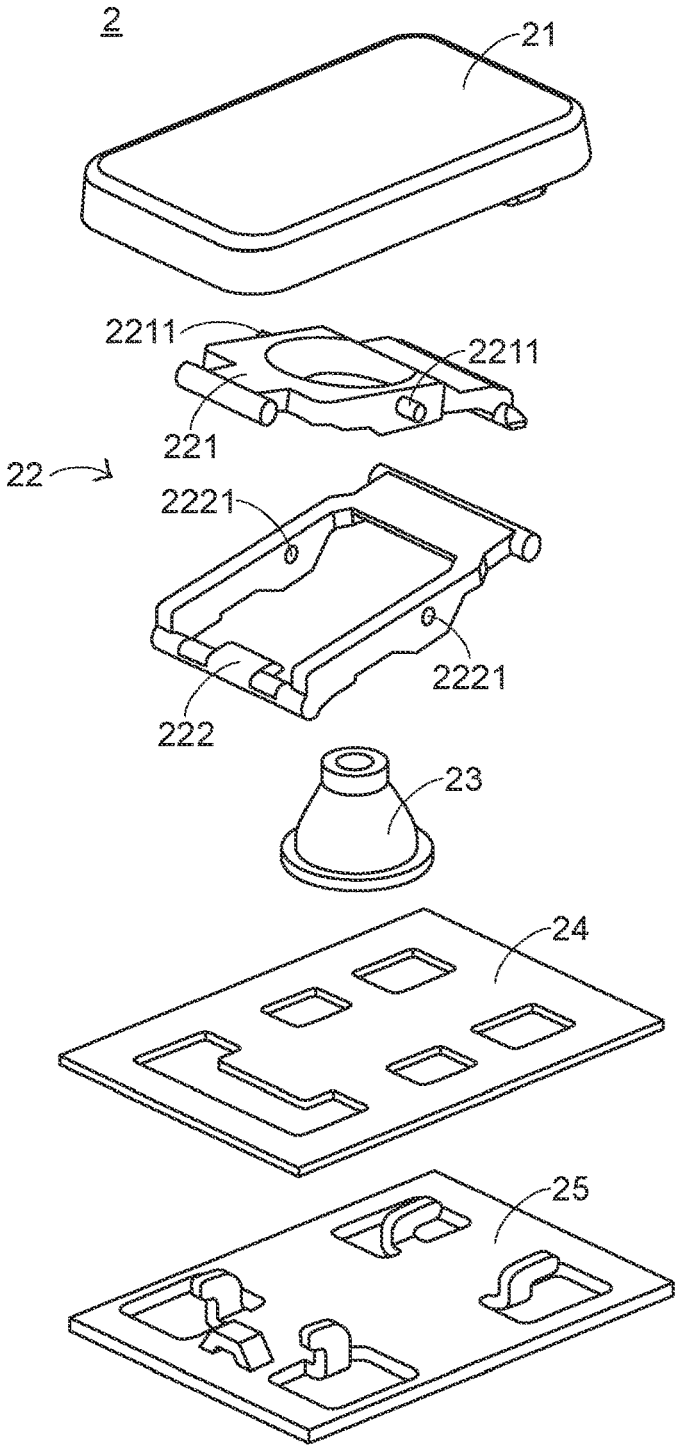
FIG.2 PRIOR ART
FIG. 2 is a schematic exploded view illustrating a key structure of a conventional keyboard device.
Figure 3:
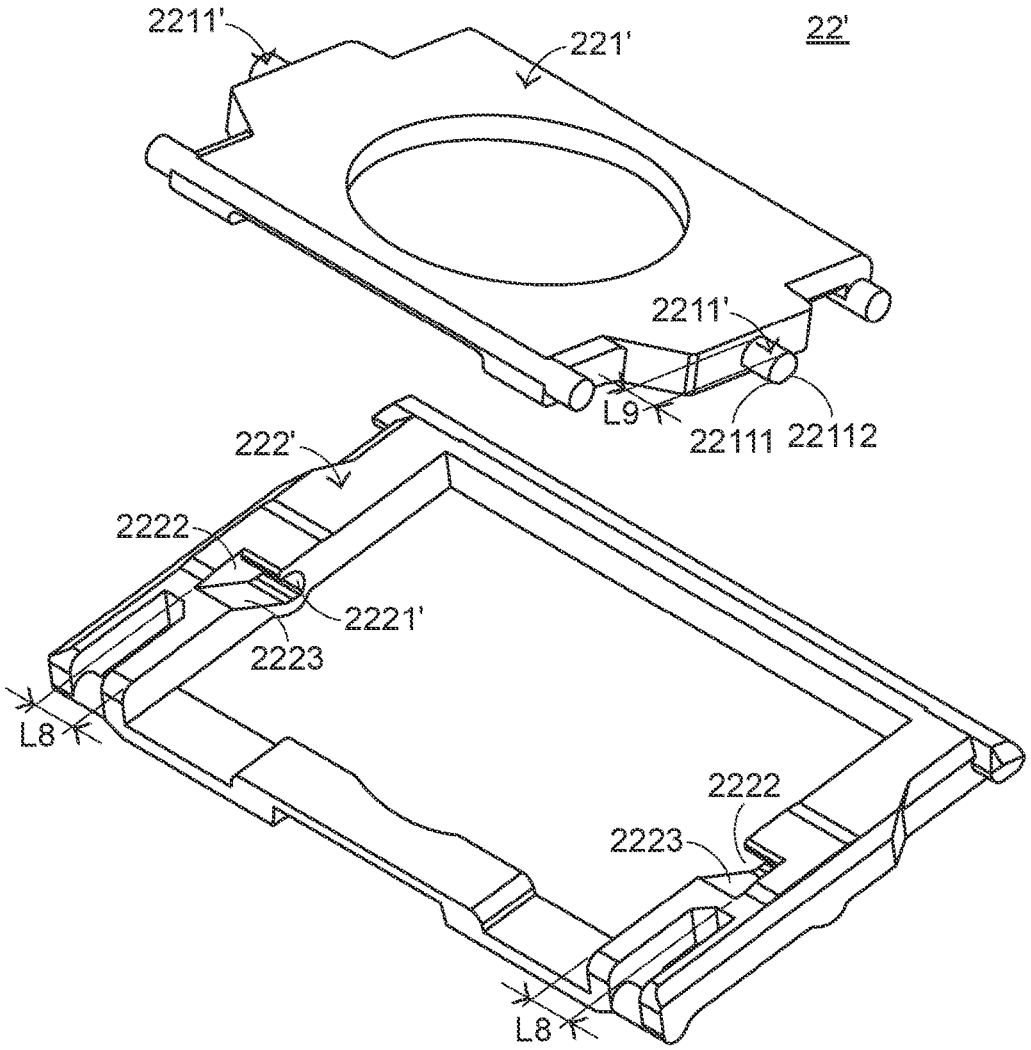
FIG.3 PRIOR ART
FIG. 3 is a schematic perspective view illustrating a scissors-type connecting member is disclosed in Taiwanese Utility Model Patent M448779.
Figure 4:
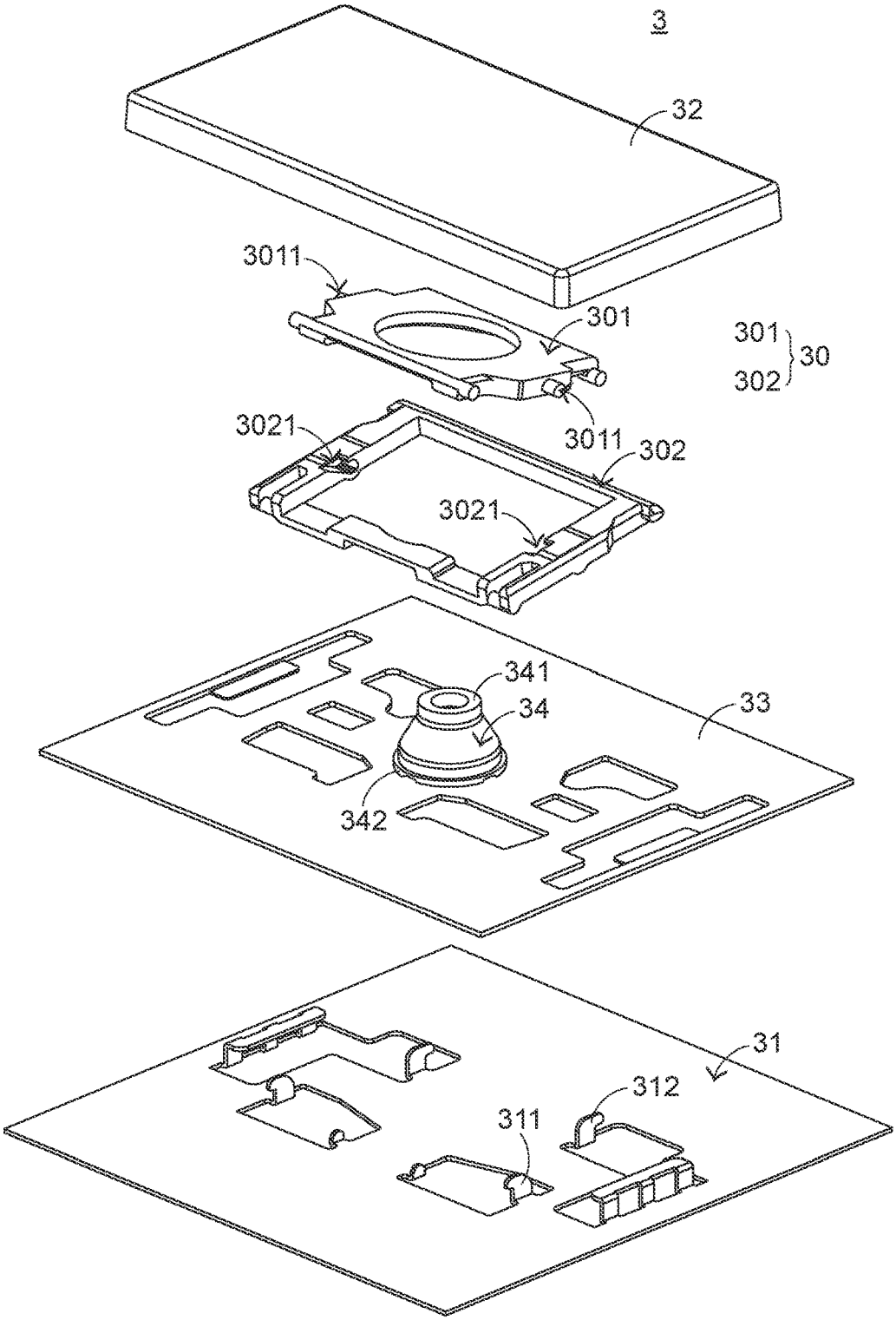
FIG. 4 is a schematic exploded view illustrating a key structure according to an embodiment of the present invention.
Figure 5:
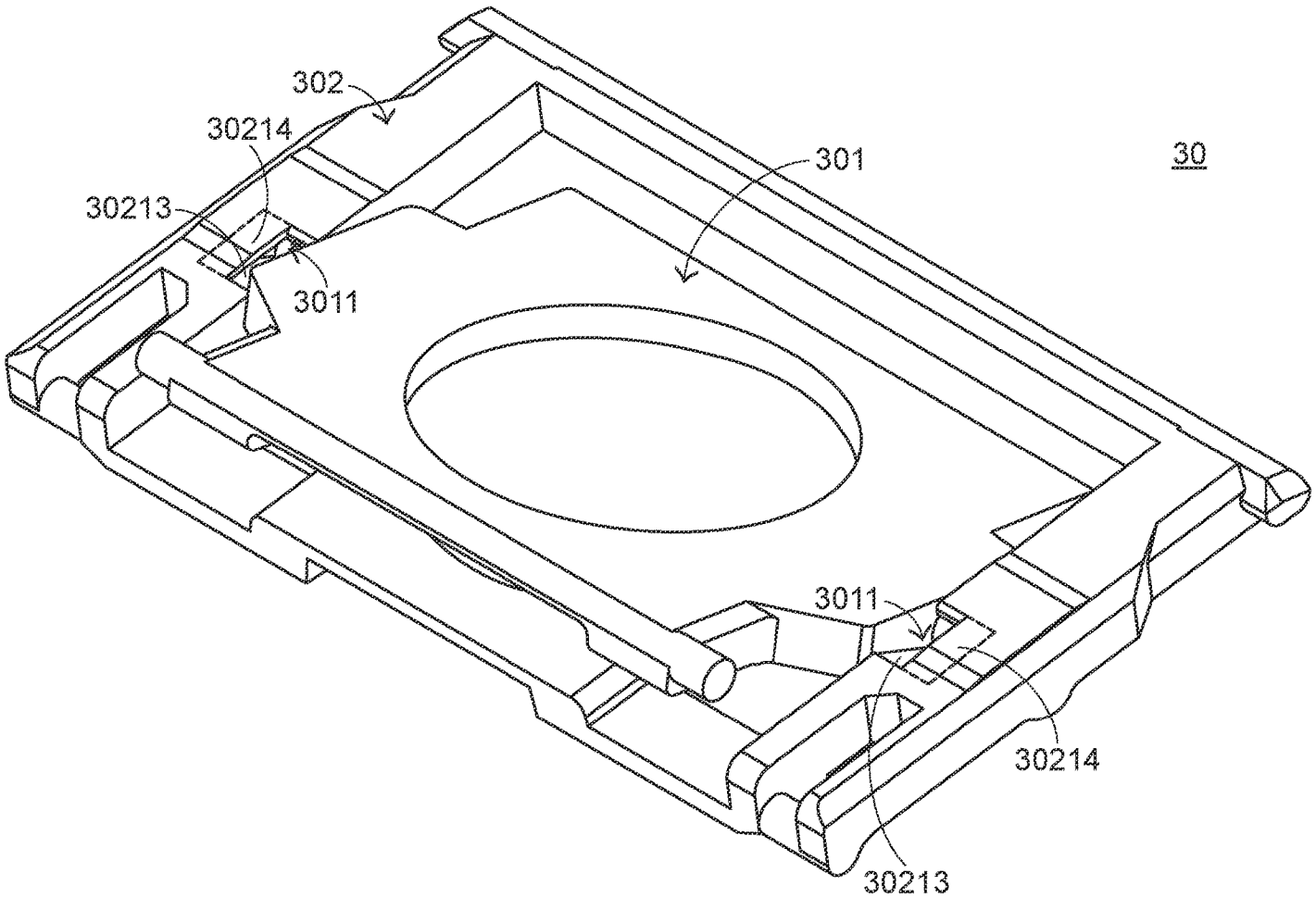
FIG. 5 is a schematic assembled view illustrating a scissors-type connecting member of the key structure of FIG. 4.

FIG. 4 is a schematic exploded view illustrating a key structure according to an embodiment of the present invention. FIG. 5 is a schematic assembled view illustrating a scissors-type connecting member of the key structure of FIG. 4. As shown in FIGS. 4 and 5, the key structure 3 comprises a scissors-type connecting member 30, a base plate 31, a keycap 32, a membrane switch circuit 33 and an elastic element 34. The scissors-type connecting member 30 is arranged between the keycap 32 and the membrane switch circuit 33. The scissors-type connecting member 30 comprises a first frame 301 and a second frame 302. The second frame 302 is pivotally coupled to the first frame 301. Consequently, the second frame 302 is swingable relative to the first frame 301. In this embodiment, the first frame 301 and the second frame 302 are an inner frame and an outer frame, respectively. Moreover, the first frame 301 is coupled to an inner side of the second frame 302.

The membrane switch circuit 33 is arranged between the base plate 31 and the elastic element 34. When the membrane switch circuit 33 is triggered, a corresponding key signal is generated. The elastic element 34 is arranged between the keycap 32 and the membrane switch circuit 33. Moreover, the elastic element 34 comprises an upper part 341 and a lower part 342. For assembling the components of the key structure 3, the upper part 341 of the elastic element 34 is penetrated through the first frame 301 and contacted with the keycap 32. The lower part 342 of the elastic element 34 is contacted with the membrane switch circuit 33.

The base plate 31 comprises a first hook 311 and a second hook 312. The first hook 311 is located at a first side of the base plate 31, and connected with a first end of the second frame 302. The second hook 312 is located at a second side of the base plate 31, and connected with a first end of the first frame 301. The keycap 32 comprises hooks (not shown), and these hooks are similar to the first hook 311 and the second hook 312. A second end of the first frame 301 and a second end of the second frame 302 are connected with the hooks of the keycap 32.

Figure 6:
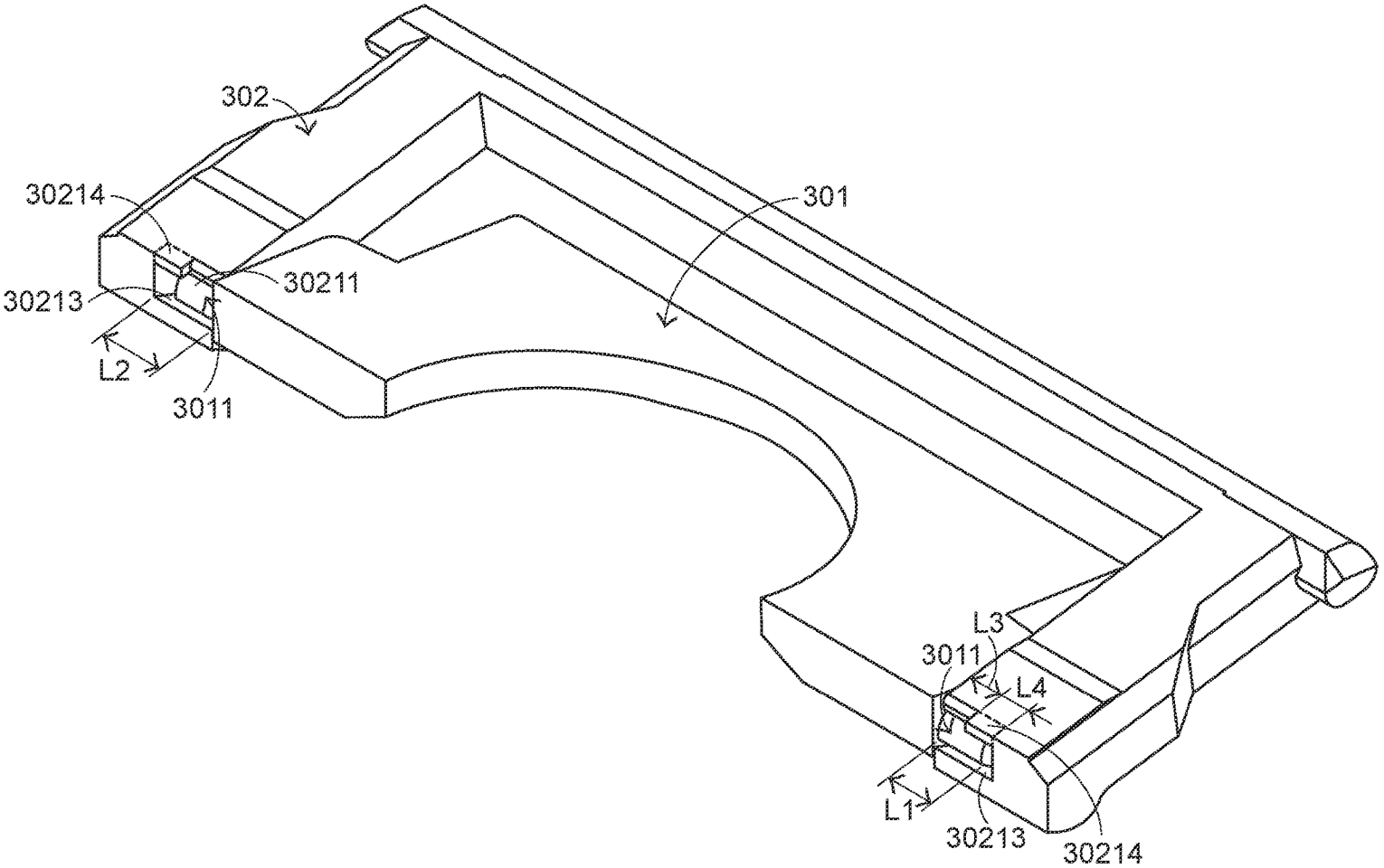
FIG. 6 is a schematic cutaway view illustrating the scissors-type connecting member of FIG. 5.
Figure 7:
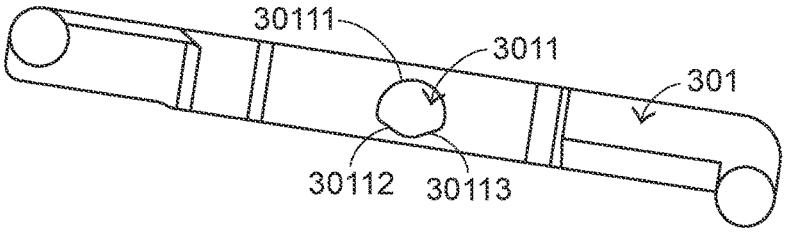
FIG. 7 is a schematic side view illustrating a portion of the first frame of the scissors-type connecting member of FIG. 5.
Figure 8:
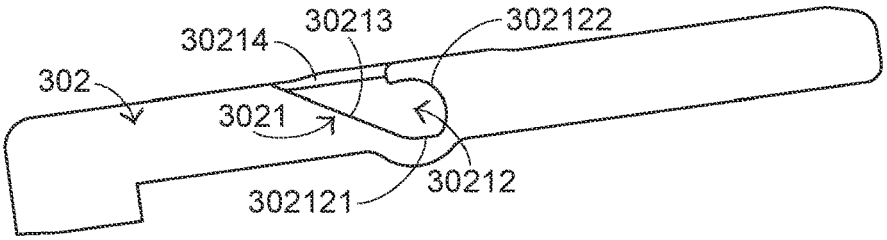
FIG. 8 is a schematic side view illustrating a portion of the second frame of the scissors-type connecting member of FIG. 5.

The detailed structure of the scissors-type connecting member 30 will be described as follows. Please refer to FIGS. 6, 7 and 8. FIG. 6 is a schematic cutaway view illustrating the scissors-type connecting member of FIG. 5. FIG. 7 is a schematic side view illustrating a portion of the first frame of the scissors-type connecting member of FIG. 5. FIG. 8 is a schematic side view illustrating a portion of the second frame of the scissors-type connecting member of FIG. 5. The first frame 301 comprises a rotating shaft 3011. The rotating shaft 3011 is disposed on an outer surface of the first frame 301. The second frame 302 comprises a mounting part 3021. The mounting part 3021 is disposed on an inner surface of the second frame 302. Moreover, the mounting part 3021 comprises an entrance 30211, a pivot hole 30212, a guiding surface 30213 and a stopper 30214. The two ends of the guiding surface 30213 are located near the entrance 30211 and a bottom side 302121 of the pivot hole 30212, respectively. For combining the first frame 301 with the second frame 302, the rotating shaft 3011 of the first frame 301 is introduced into the pivot hole 30212 through the entrance 30211 and along the guiding surface 30213. Consequently, the first frame 301 is pivotally coupled to the second frame 302.

The stopper 30214 is located near the entrance 30211 or arranged between the entrance 30211 and the pivot hole 30212. The stopper 30214 is used for stopping the rotating shaft 3011. Consequently, the position of the rotating shaft 3011 is limited between the stopper 30214 and the pivot hole 30212. In this embodiment, a top surface of the stopper 30214 is located near the entrance 30211. Moreover, the stopper 30214 has a stopper width L4 corresponding to an axial length L1 of the rotating shaft 3011, and the entrance 30211 has an entrance width L3 corresponding to the axial length L1 of the rotating shaft 3011. The sum of the stopper width L4 and the entrance width L3 is substantially equal to a depth L2 of the pivot hole 30212. Since the axial length L1 of the rotating shaft 3011 of the inner frame 221 is equal to or slightly smaller than the depth L2 of the pivot hole 30212, the stopper width L4 of the stopper 30214 and the entrance width L3 of the entrance 30211 are both smaller than the axial length L1 of the rotating shaft 3011.

As mentioned above, the entrance width L3 of the entrance 30211 of the mounting part 3021 of the second frame 302 is smaller than the axial length L1 of the rotating shaft 3011. Consequently, for combining the first frame 301 with the second frame 302, an external force is applied to the rotating shaft 3011 of the first frame 301 at the entrance 30211 of the mounting part 3021 of the second frame 302 in order to result in slight deformation. Consequently, the rotating shaft 3011 of the first frame 301 is introduced into the mounting part 3021 through the entrance 30211 of the mounting part 3021 and moved to the pivot hole 30212 along the guiding surface 30213.

In other words, the stopper 30214 of the mounting part 3021 of the second frame 302 provides the function of stopping the rotating shaft 3011 of the first frame 301. That is, if the assembled keyboard with the key structure 3 drops down (e.g., drops down accidentally or undergoes a reliability drop test before leaving the factory) or the assembled keyboard is hit by an external force, the rotating shaft 3011 of the first frame 301 is stopped by the stopper 30214. Consequently, the rotating shaft 3011 of the first frame 301 is not escaped from the entrance 30211 of the mounting part 3021 of the second frame 302. Under this circumstance, the stability of connecting the first frame 301 and the second frame 302 is enhanced.

In this embodiment, the rotating shaft 3011 of the first frame 301 comprises a curved periphery 30111 and two flat slant surfaces 30112 and 30113. The two flat slant surfaces 30112 and 30113 are extended from two opposite sides of the curved periphery 30111, respectively. In addition, the two flat slant surfaces 30112 and 30113 are intersected with each other and symmetrical to each other. The top side 302122 and the bottom side 302121 of the pivot hole 30212 of the mounting part 3021 of the second frame 302 are a curved surface and a flat surface, respectively.

Figure 9:
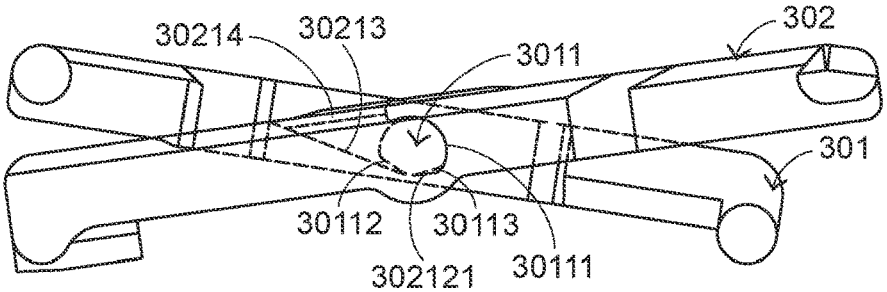
FIG. 9 schematically illustrates a process of assembling the scissors-type connecting member of FIG. 5.

FIG. 9 schematically illustrates a process of assembling the scissors-type connecting member of FIG. 5. A process of combining the first frame 301 with the second frame 302 will be described as follows. Firstly, an external force is applied to the rotating shaft 3011 of the first frame 301 in order to result in slight deformation. Consequently, the rotating shaft 3011 of the first frame 301 is introduced into the mounting part 3021 through the entrance 30211. Then, the flat slant surface 30113 of the rotating shaft 3011 is contacted with the guiding surface 30213 under the entrance 30211 of the mounting part 3021, and continuously moved to the pivot hole 30212 along the guiding surface 30213. Then, the flat slant surface 30113 of the rotating shaft 3011 is contacted with the bottom of the pivot hole 30212.

After the rotating shaft 3011 of the first frame 301 is introduced into the pivot hole 30212 of the mounting part 3021 of the second frame 302, the curved periphery 30111 of the rotating shaft 3011 is contacted with the top side 302122 of the pivot hole 30212. Moreover, as the first frame 301 is rotated relative to the second frame 302, the two flat slant surfaces 30112 and 30113 of the rotating shaft 3011 are respectively stopped by the guiding surface 30213 of the mounting part 3021 and the bottom side 302121 of the pivot hole 30212. That is, the guiding surface 30213 of the mounting part 3021 and the bottom side 302121 of the pivot hole 30212 interfere with the two flat slant surfaces 30112 and 30113 of the rotating shaft 3011. Consequently, the rotating angle of the inner frame 301 relative to the outer frame 3022 is limited.

Figure 10:
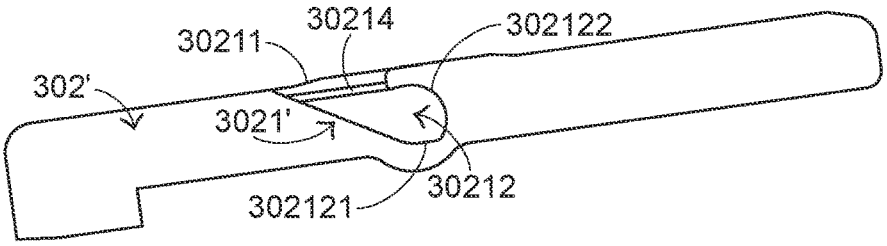
FIG. 10 is a schematic side view illustrating a portion of a second frame of a scissors-type connecting member according to another embodiment of the present invention.

In the above embodiment, the shape of the rotating shaft 3011 of the first frame 301 and the shape of the pivot hole 30212 of the mounting part 3021 of the second frame 302 are presented herein for purpose of illustration and description only. It is noted that numerous modifications and alterations of the key structure may be made while retaining the teachings of the invention. FIG. 10 is a schematic side view illustrating a portion of a second frame of a scissors-type connecting member according to another embodiment of the present invention. In this embodiment, a top surface of the stopper 30214 of the mounting part 3021' of the second frame 302' is in parallel with the entrance 30211 and lower than the entrance 30211. Similarly, the stopper width of the stopper 30214 is smaller than the axial length of the rotating shaft 3011 of the first frame 301. In other words, the stopper 30214 also provides the function of stopping the rotating shaft 3011 of the first frame 301. Consequently, the rotating shaft 3011 of the first frame 301 is not escaped from the entrance 30211 of the mounting part 3021'.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A scissors-type connecting member, comprising:

a first frame comprising a rotating shaft, wherein the rotating shaft is disposed on an outer surface of the first frame; and a second frame comprising a mounting part, wherein the mounting part is disposed on an inner surface of the second frame, and the mounting part comprises an entrance, a pivot hole and a stopper, wherein after the rotating shaft is introduced into the pivot hole through the entrance, the first frame is pivotally coupled to the second frame, wherein the stopper is located near the entrance or arranged between the entrance and the pivot hole, and a position of the rotating shaft is limited between the stopper and the pivotal hole by the stopper; wherein a top surface of the stopper is located near the entrance, and the stopper has a stopper width corresponding to an axial length of the rotating shaft, the entrance has an entrance width corresponding to the axial length of the rotating shaft; wherein the stopper width and the entrance width are both smaller than the axial length of the rotating shaft.

2. The scissors-type connecting member according to claim 1, wherein a sum of the entrance width and the stopper width is substantially equal to a depth of the pivot hole.

3. The scissors-type connecting member according to claim 1, wherein a top surface of the stopper is in parallel with the entrance and lower than the entrance.

4. The scissors-type connecting member according to claim 1, wherein the mounting part further has a guiding surface, and two ends of the guiding surface are located near the entrance and a bottom side of the pivot hole, respectively, wherein the rotating shaft is guided to the pivot hole along the guiding surface.

5. The scissors-type connecting member according to claim 4, wherein a top side of the pivot hole has a curved surface, and the bottom side of the pivot hole is has flat surface, wherein the rotating shaft comprises a curved periphery and two flat slant surfaces, and the two flat slant surfaces are respectively extended from two opposite sides of the curved periphery, wherein after the rotating shaft is introduced into said pivot hole, the curved periphery is contacted with the top side of the pivot hole, and the bottom side of the pivot hole and the guiding surface interfere with the two flat slant surfaces, so that a rotating angle of the first frame relative to the second frame is limited.

6. A key structure, comprising:

a base plate;

a keycap disposed over the base plate; and a scissors-type connecting member arranged between the base plate and the keycap, wherein the keycap is moved upwardly or downwardly relative to the base plate through the scissors-type connecting member, and the scissors-type connecting member comprises:

a first frame comprising a rotating shaft, wherein the rotating shaft is disposed on an outer surface of the first frame; and a second frame comprising a mounting part, wherein the mounting part is disposed on an inner surface of the second frame, and the mounting part comprises an entrance, a pivot hole and a stopper, wherein after the rotating shaft is introduced into the pivot hole through the entrance, the first frame is pivotally coupled to the second frame, wherein the stopper is located near the entrance or arranged between the entrance and the pivot hole, and a position of the rotating shaft is limited between the stopper and the pivotal hole by the stopper; wherein a top surface of the stopper is located near the entrance, and the stopper has a stopper width corresponding to an axial length of the rotating shaft, the entrance has an entrance width corresponding to the axial length of the rotating shaft; wherein the stopper width and the entrance width are both smaller than the axial length of the rotating shaft.

7. The key structure according to claim 6, wherein a sum of the entrance width and the stopper width is substantially equal to a depth of the pivot hole.

8. The key structure according to claim 6, wherein a top surface of the stopper is in parallel with the entrance and lower than the entrance.

9. The key structure according to claim 6, wherein the mounting part further has a guiding surface, and two ends of the guiding surface are located near the entrance and a bottom side of the pivot hole, respectively, wherein the rotating shaft is guided to the pivot hole along the guiding surface.

10. The key structure according to claim 9, wherein a top side of the pivot hole has a curved surface, and the bottom side of the pivot hole has a flat surface, wherein the rotating shaft comprises a curved periphery and two flat slant surfaces, and the two flat slant surfaces are respectively extended from two opposite sides of the curved periphery, wherein after the rotating shaft is introduced into said pivot hole, the curved periphery is contacted with the top side of the pivot hole, and the bottom side of the pivot hole and the guiding surface interfere with the two flat slant surfaces, so that a rotating angle of the first frame relative to the second frame is limited.

11. The key structure according to claim 9, further comprising:

a membrane switch circuit disposed on the base plate, wherein when the membrane switch circuit is triggered, a key signal is generated; and an elastic element disposed on the membrane switch circuit, wherein a lower part of the elastic element is contacted with the membrane switch circuit, the elastic element is penetrated through the scissors-type connecting member, and an upper part of the elastic element is contacted with the keycap, wherein the elastic element triggers the membrane switch circuit when the elastic element is pushed by keycap, or the elastic element provides an elastic force to the keycap.

* * * * *